United States Patent [19]

Cremer

[11] Patent Number: 4,462,797

[45] Date of Patent: Jul. 31, 1984

[54] COOLING ZONE FOR A KILN, MORE SPECIALLY A ROLLER KILN

[76] Inventor: Gottfried Cremer, Steyrer Weg 6, 5000 Köln 40 (Junkersdorf), Fed. Rep. of Germany

[21] Appl. No.: 375,025

[22] PCT Filed: Aug. 28, 1981

[86] PCT No.: PCT/DE81/00133

§ 371 Date: Apr. 21, 1982

§ 102(e) Date: Apr. 21, 1982

[87] PCT Pub. No.: WO82/00876

PCT Pub. Date: Mar. 18, 1982

[51] Int. Cl.[3] ..... F28F 27/00; F27D 15/02; F27B 9/00; F27B 5/04

[52] U.S. Cl. ..... 432/77; 165/96; 432/83; 432/148; 432/198

[58] Field of Search ..... 432/77, 83, 147, 148, 432/198; 165/96 HV, DIG. 76

[56] References Cited

U.S. PATENT DOCUMENTS

| | | | |
|---|---|---|---|
| 2,066,376 | 1/1937 | Walters | 165/DIG. 6 |
| 2,231,716 | 2/1941 | Hansen | 432/198 |
| 2,968,894 | 1/1961 | Hess | 432/18 |
| 3,500,899 | 3/1970 | Shane, Jr. | 165/96 HV |
| 4,256,606 | 3/1981 | Noack et al. | 432/77 |
| 4,334,505 | 6/1982 | Jablin | 122/27 |

FOREIGN PATENT DOCUMENTS

| | | | |
|---|---|---|---|
| 1303162 | 5/1971 | Fed. Rep. of Germany | 432/77 |
| 954674 | 4/1964 | United Kingdom . | |

*Primary Examiner*—John J. Camby
*Attorney, Agent, or Firm*—Price, Heneveld

[57] ABSTRACT

The cooling zone (24) for a kiln, more specially a roller kiln, made up of a preheating zone (21), a firing zone (22) and a cooling zone (24), through which the goods to be kilned (10), more specially ceramic tiles or plates are transported without any burning tools of refractory material supporting them, is (for the purpose of stopping any effect on the kilned goods in the cooling zone (24) and in the parts next to the cooling zone (24), because of the effect of the atmosphere in the cooling (24) and any reoxidation of the kilned goods (10) because of this, and for giving a simple way of producing effect on the outer face of the kilned goods (10) using a moving heat vehicle, more specially liquid heat vehicle) is indirectly cooled, and has inlet systems, able to undergo adjustment in their direction and their rate of inlet, for materials for producing an effect on the outer face of the kilned goods. The indirect cooling is more specially produced by having tube coils or tube banks (3) for the heat vehicle in the cooling zone (24) over the kilned goods (10). The outer faces of such tubes taking up radiant heat are controlledly screened off, (at 5) on the kilned goods (10) and are placed so as to be normal to the direction of motion of the kilned goods (10). The screening system (5) may be made up of slotted plates able to be moved in relation to each other, or slotted plates able to be changed in position in relation to each other. The tube coils or banks of tubes (3) for the heat medium may be joined up with plants, or parts of the kiln, for recovery of the heat.

1 Claim, 3 Drawing Figures

COOLING ZONE FOR A KILN, MORE SPECIALLY A ROLLER KILN

The present invention is with respect to the design of the cooling zone of a firing kiln made up of a preheating zone, a firing zone and a cooling zone, and more specially a roller kiln through which the material to be fired, more specially ceramic tiles or panels, is moved in a single layer without using any burning tools of refractory material.

In such a roller kiln designed for firing material in a single layer and without any burning tools of refractory material, the material to be fired makes its way through the preheating zone, the firing zone and the cooling zone on a line of rollers made up of a special-purpose steel or ceramic refractory material and powered from a point outside the kiln. The specially useful effect of such kilns is that they make do without using carriages and refractory burning tools. Such transporting and supporting parts do in fact have a great mass which has to be heated up by the kiln and then cooled down again in the cooling zone so that one may see that a great part of the heat input to the kiln for the purpose of heating up the material to be fired is in fact wasted.

In such kilns firing goods in a single layer and without using transport carriages and burning tools not only is much less heat needed, but furthermore the firing operation takes place more quickly and more evenly so that the production cycles are very much shorter.

The cooling zone of such a kiln is generally run to give a quenching effect, that is to say great enough amounts of air are forced into the cooling zone to take effect on the goods. However one undesired effect of this is that, even if the firing zone is separated from the cooling zone by a curtain, the cooling zone has effects on the firing zone and, if the firing zone is run under reducing conditions, the fired goods will be reoxidized in the cooling zone again and at least in the part of the firing zone next to the cooling zone. For one way of stopping the goods from becoming reoxidized in the cooling zone and stopping such a reoxidizing effect taking place in the part of the firing zone next to the cooling zone, see, for example, German Offenlegungsschrift specification No. 2,824,367 in which the input of materials for reduction in the cooling zone, into the kiln with a high pressure is intermittent, the amounts and the timing of such material being such that the amount, still unused, of reducing material after part-reduction is so low that it is burned off by the neutral kiln atmosphere in the times in which there is no supply of reducing material, no further supply thereof in addition being needed in such times for burning off the reducing substances.

It will be seen that for running such a process a very complex control system is needed.

The purpose of the invention is to make use of a very simple system for producing the desired effect of the fired goods in the cooling zone and the part next thereto by the atmosphere of the cooling zone and for this reason stopping any reoxidation of the fired goods, while at the same time making it simple for effects to be produced on the outer face of the fired goods.

For effecting this purpose in the invention the cooling zone is indirectly cooled by a current of heat vehicle, more specially a liquid heat vehicle, and the cooling zone has inlet systems, able to be changed in direction and in their rate of input, for materials taking effect on the outer face of the goods being kilned.

On using a liquid heat vehicle, for example water, forced through the tube coils into the cooling zone over the kilned goods, there is a sharp, quick quenching of the kilned goods in the cooling zone without however any danger of changing the atmosphere, as would be the case on pumping in cooling air. At the same time however an atmosphere is produced in the cooling zone which is generally at rest and it is now possible for air or any other material having a desired effect on the outer face of the kilned goods, to be let into the cooling zone, the amount and direction of the material being controlled. To take an example, for processing the glaze a gas or a vapor of the sort for this purpose may be let into the cooling zone.

For stopping any scale or the like, which may be dropped off the tube coils or banks for the heat vehicle, from falling onto the goods being kilned, such tubes may screened off from the goods. As a possible further development of the invention, the outer faces of the tubes for the heat vehicle which take up radiant heat may be screened off controlledly from the goods being kilned, this not only safeguarding the goods being kilned, but furthermore making it possible for the cooling operation to be controlled in the best possible way as may be desired.

The tube coils or banks are best placed so as to be normal to the direction of motion of the goods being kilned through the kiln, because this makes the inlet and outlet of the heat vehicle specially simple. Furthermore the placing and operation of the screening system is very much simpler when the tubes and coils or banks are so placed.

The controlled screening system is best made up of louver-like or paddle-like turning elements generally completely screening off the cooling tubes in the shut condition and only having to be turned somewhat for producing slot-like openings through which the atmosphere, which is to be cooled down to a low temperature, may quickly make its way downwards onto the kilned goods.

In place of louver-like curtains it is furthermore possible to have slotted plates whose degree of overlap may be changed as desired for increasing or decreasing the size of openings for cooled atmosphere to make its way down onto the goods being kilned. Because of this possible adjustment of the screening system it is possible for the cooling down process in the cooling zone to be changed in any way desired.

A further useful effect produced by the invention is that the tube coils or banks for the heat vehicle may be joined up with heat recovery systems or with other parts of the kiln.

Figure 1:
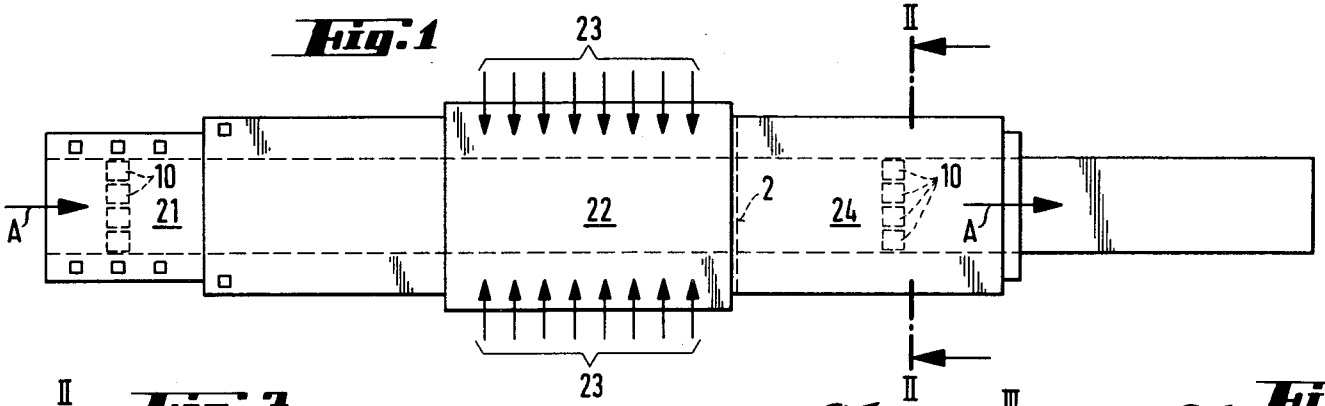
FIG. 1 is a diagrammatic plan view of a kiln.
Figure 2:
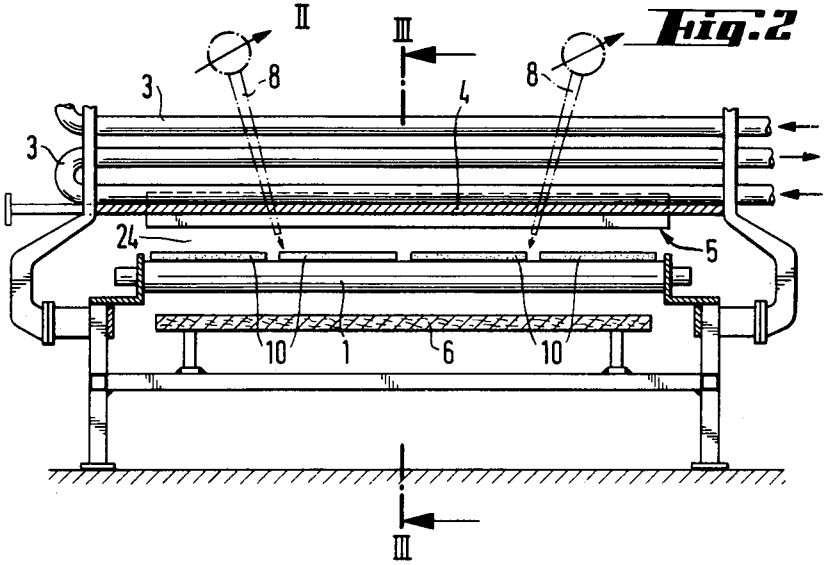
FIG. 2 is a section on the line II—II of FIG. 1.
Figure 3:
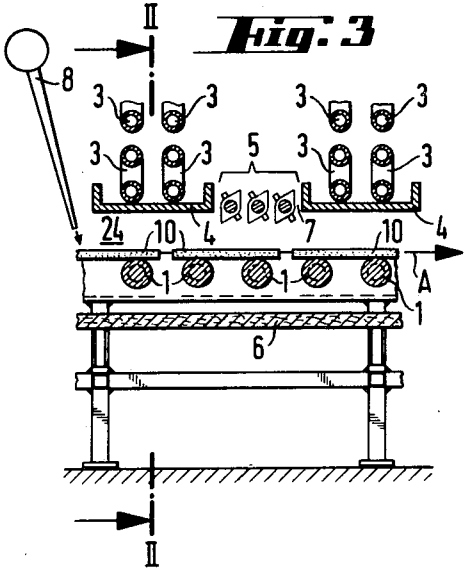
FIG. 3 is a part of a lengthways section through the cooling zone.

A kiln used for goods to be fired, and more specially ceramic plates or tiles, coming in in the direction of arrow A, has a preheating zone 21, a firing zone 22, heated by burners in the direction of arrows 23, and the cooling zone 24 from which the completely fired and cooled down goods make their way out of the kiln. The kilned goods 10 are transported on rollers through the kiln, it being possible to see one roller at 1 in FIG. 2 and a number of them, marked 1 as well in FIG. 3, such rollers forming a roller transporter running from the inlet to the outlet of the kiln, and being powered from an outside unit, for transporting the goods 10 to be kilned thereon through the kiln. In cooing zone 24 cooling has in the prior art so far been undertaken by cooling air forced into the cooling zone by blowers placed over and under the roller transporter. Even using a curtain marked at 2 in FIG. 1 between the firing zone and the cooling zone, it is not possible to see that this cooling air does not have an effect on the firing zone and for this reason an effect on the atmosphere therein. As part of the invention the cooling down of the kilned goods 10 takes place in the cooling zone 24 not, as in the prior art, by blowing in cooling air, but by indirect cooling using a moving heat vehicle, more specifically a liquid heat vehicle such as water, which is forced through the cooling coils or banks 3 (which are more specially normal to the direction of motion of the kilned goods) in the top part of the cooling zone. The atmosphere in the cooling zone is then kept at rest and it is not possible for it to have any effect on the firing zone. A reducing gas, salt vapors or the like as may be desired for having an effect on the outer face of the kilned goods in the desired way may be run into this still atmosphere, for example by way of long pipes 8 at a controlled rate, a change in the direction of the pipe 8 furthermore being possible. Because inlet takes place into an atmosphere at rest, rate control is simple and uncomplex and may be undertaken in such a way that there are no undesired effects on the part of the firing zone next to the cooling zone. For stopping any scale or the like that may have been formed on the cooling coils or banks 3, from falling on the goods to be kilned, there is on the one hand a fixed screen system, marked at 4, and on the other hand a screening system in the form of louvers as marked at 5. This louver system is made up of paddle-like elements stretching cross-wise over the cooling zone and able to undergo adjustment for generally completely shutting off the spaces between the fixed screens 4, this not only being a further way of safeguarding the kilned goods on rollers 1 but furthermore giving control of the rate of the cooling operation. It is naturally possible, in place of the paddle-like elements to be seen in FIG. 3, to have a system made up of slotted plates running across or along a cooling zone so that the degree of overlap of the slots may be changed so decreasing or increasing the size of the holes for controlling the cooling effect on the kilned goods which are transported on rollers 1.

Under the rollers there is refractory insulation 6.

The cooling tubes or banks of tubes 3 may be joined, in a way not to be seen in the figures, with other plant or other parts of the kiln, for example with a preheating zone so that a part of the heat in the heat vehicle may be used for preheating the goods being kilned. The amounts of heat taken up by the heat vehicle may furthermore be used in some other way, for example for drying.

I claim:

1. A kiln for firing ceramic tiles, said kiln having a housing, said housing having preheating, firing, and cooling zones arranged in tandem therein, a transport means consisting of a plurality of driven rollers forming a transport surface extending through said zones for transporting the tiles therethrough in a single layer, said kiln characterized in that said cooling zone forms a chamber having a non-oxidizing atmosphere which is substantially self-contained and static except for currents resulting from thermal convection, a plurality of conduits containing a moving thermal energy absorbing liquid mounted in said cooling zone of said kiln above said transport means, said conduits extending normal to the direction of movement of tiles on said transport means, said conduits being arranged in groups spaced apart lengthwise of the kiln, a stationary debris catching plate beneath each group, said plates being spaced to provide a flow path therebetween for the upward passage of gases heated by the tiles, an adjustable damper element mounted between adjacent plates and in the flow path for controlling the flow rate of heated gas through said flow path for regulating the rate of cooling of the tiles, and further characterized in that a refractory panel is provided in said cooling zone only beneath said transport means; and further characterized in that gas introduction means is provided for introducing gas having a desired property into said chamber to regulate the atmosphere to produce a desired effect on the surface of the kilned goods transported through said cooling zone, said gas introduction means including gas inlet means positioned below said debris catching plates and above said rollers for directing the gas directly into the kilned goods transported through the cooling zone.

* * * * *

UNITED STATES PATENT AND TRADEMARK OFFICE

CERTIFICATE OF CORRECTION

PATENT NO. : 4 462 797

DATED : July 31, 1984

INVENTOR(S) : Gottfried Cremer

It is certified that error appears in the above—identified patent and that said Letters Patent is hereby corrected as shown below:

Column 4, claim 1, line 44:

"into" should be --onto--

Signed and Sealed this

*Nineteenth* Day of *March 1985*

[SEAL]

*Attest:*

DONALD J. QUIGG

*Attesting Officer*

*Acting Commissioner of Patents and Trademarks*